US011149379B2

(12) United States Patent
Lee et al.

(10) Patent No.: US 11,149,379 B2
(45) Date of Patent: Oct. 19, 2021

(54) SYSTEM IRON

(71) Applicant: LG Electronics Inc., Seoul (KR)

(72) Inventors: Youngjoo Lee, Seoul (KR); Woosup Shin, Seoul (KR)

(73) Assignee: LG Electronics Inc., Seoul (KR)

( * ) Notice: Subject to any disclaimer, the term of this patent is extended or adjusted under 35 U.S.C. 154(b) by 46 days.

(21) Appl. No.: 16/474,920

(22) PCT Filed: Dec. 29, 2017

(86) PCT No.: PCT/KR2017/015700
§ 371 (c)(1),
(2) Date: Jun. 28, 2019

(87) PCT Pub. No.: WO2018/124796
PCT Pub. Date: Jul. 5, 2018

(65) Prior Publication Data

US 2020/0123698 A1 Apr. 23, 2020

(30) Foreign Application Priority Data

Dec. 30, 2016 (KR) ..... 10-2016-0184188

(51) Int. Cl.
*D06F 73/00* (2006.01)
*D06F 81/04* (2006.01)
*D06F 81/08* (2006.01)

(52) U.S. Cl.
CPC ..... *D06F 73/00* (2013.01); *D06F 81/04* (2013.01); *D06F 81/08* (2013.01)

(58) Field of Classification Search
CPC ..... D06F 73/00; D06F 81/04; D06F 81/08; D06F 81/003; D06F 81/006; D06F 81/00;
(Continued)

(56) References Cited

U.S. PATENT DOCUMENTS 3,543,282 A * 11/1970 Emile Lucien ..... A47B 27/14 108/147
3,715,997 A * 2/1973 Barth ..... A47B 23/046 108/146
(Continued)

FOREIGN PATENT DOCUMENTS

CN 101213336 A 7/2008
CN 101213337 A 7/2008
(Continued)

OTHER PUBLICATIONS

PCT Search Report in PCT International Patent Application No. PCT/KR2017/015700, dated May 23, 2018 (3 pages).
(Continued)

*Primary Examiner* — Ismael Izaguirre
(74) *Attorney, Agent, or Firm* — Finnegan, Henderson, Farabow, Garrett & Dunner LLP

(57) ABSTRACT

The present invention relates to a system iron. The system iron of the present invention includes a body including therein a steam generator for generating steam; an ironing plate disposed on the body so as to spray the steam generated by the steam generator to an outside; a height adjustment box, which is retracted into the body and extended outwards from the body so as to adjust a height of the ironing plate; a lock including a first bar, which projects outwards from the height adjustment box so as to limit the movement of the height adjustment box; a lock holder, which is connected to two side surfaces of an end of the lock so as to change the position of the first bar, thereby allowing the height adjustment box to be moved; and a height adjustment lever for moving the lock holder via a wire.

11 Claims, 15 Drawing Sheets

(58) Field of Classification Search
CPC ..... D06F 81/02; D06F 81/10; D06F 81/12; D06F 79/06; D06F 71/16; D06F 71/20; D06F 71/26; D06F 71/28; D06F 71/285; D06F 71/30; D06F 71/36; D06F 71/40; A47B 9/00; A47B 9/06; A47B 9/14; A47B 13/02; A47B 13/023; A47B 27/14; A47B 37/00
USPC ..... D32/9
See application file for complete search history.

(56) References Cited

U.S. PATENT DOCUMENTS

| | | | | |
|---|---|---|---|---|
| 4,956,929 | A * | 9/1990 | Chirabandalsuk | D06F 81/00 108/6 |
| 5,778,573 | A * | 7/1998 | Nottingham | D06F 81/06 108/42 |
| 6,443,075 | B1 | 9/2002 | Hahn et al. | |
| 8,266,830 | B2 * | 9/2012 | Ma | D06F 81/08 38/139 |
| 2010/0146827 | A1 | 6/2010 | Ma et al. | |
| 2015/0233046 | A1 | 8/2015 | Puckett, Sr. | |
| 2016/0047083 | A1 * | 2/2016 | Yoo | D06F 29/00 38/1 A |

FOREIGN PATENT DOCUMENTS

| | | | | |
|---|---|---|---|---|
| CN | 104878580 | A | | 9/2015 |
| EP | 270827 | A | * | 6/1988 |
| JP | 03297499 | A | * | 12/1991 |
| KR | 10-2004-0088812 | | | 10/2004 |
| KR | 10-2006-0104067 | | | 10/2006 |
| KR | 20-0438161 | U | | 1/2008 |
| KR | 10-2015-0012868 | | | 2/2015 |
| WO | WO 2007057419 | A1 | * | 5/2007 |
| WO | WO 2014/076728 | A2 | | 5/2014 |
| WO | WO 2016116297 | A1 | * | 7/2016 |

OTHER PUBLICATIONS

European Search Report in European Patent No. 17885620.9, dated Jul. 27, 2020 (7 pages).
Chinese Office Action for Chinese Application No. 201780087780.X, dated Nov. 4, 2020.

* cited by examiner

SYSTEM IRON

CROSS-REFERENCE TO RELATED APPLICATIONS

This application is the U.S. national phase entry under 35 U.S.C. § 371 from PCT International Application No. PCT/KR2017/015700, filed Dec. 29, 2017, which claims the benefit of priority of Korean Patent Application No. 10-2016-0184188, filed Dec. 30, 2016, the contents of all of which are incorporated herein by reference in their entireties.

TECHNICAL FIELD

The present invention relates to a system iron, and more particularly to a system iron capable of adjusting the height of an ironing plate.

BACKGROUND ART

In wrinkle removal from clothing, there are the case in which ironing using an iron is required and the case in which garment steaming is required, depending on the type of clothing. However, there is a problem in that wrinkle removal is troublesome because different devices have to be used as needed.

In addition, there is also a problem of troublesome in which a top such as a dress shirt, which is closed by buttons, has to be buttoned up again on a garment steamer before being held on the garment steamer in the case of performing garment steaming.

Although Korean Unexamined Patent Publication Nos. 10-2016-0066224 and 10-2012-0018486 disclose steaming apparatuses in which steam is sprayed inside clothing, there is a problem in that the steaming apparatuses cannot perform an ironing operation using an iron.

In addition, as for an apparatus designed to adjust the height of an ironing plate, Korean Unexamined Patent Publication No. 10-2013-0088960 discloses a structure capable of adjusting the height thereof in a folding manner. However, when the height of the ironing plate is adjusted by moving the height adjustment apparatus, there is a problem in that there is no concrete solution for stably adjusting or maintaining the height of the ironing plate.

RELATED ART DOCUMENT

Patent Documents

Korean Unexamined Patent Publication No. 10-2016-0066224A

Korean Unexamined Patent Publication No. 10-2012-0018486A

DISCLOSURE

Technical Problem

An object to be accomplished by the present invention is to provide a system iron capable of performing a wrinkle removal operation in various ways.

Another object to be accomplished by the present invention is to provide a system iron capable of stably supporting an ironing plate and of adjusting the height of the ironing plate.

A further object to be accomplished by the present invention is to provide a system iron capable of stably maintaining the height of an ironing plate even when external force is applied thereto.

Technical Solution

The system iron according to the present invention includes a body including a steam generator for generating steam; an ironing plate rotatably disposed on the body and spraying the steam, which is generated by the steam generator, to an outside thereof, a top being hung on an outer side of the ironing plate; a spreading unit for tensioning the top hung on the outer side of the ironing plate; a front press for holding a front surface of the top, which is hung on the outer side of the ironing plate; and a pair of arm tensioners for tensioning sleeves of the top hung on the outer side of the ironing plate, whereby it is possible to perform both ironing and garment steaming by changing the position of the ironing plate and to easily hold the front surface of the top using the front press.

The system iron according to the present invention includes a height adjustment box, which is retracted into the body and is extended outwards from the body so as to adjust the height of the ironing plate; a lock including a first bar, which projects outwards from the height adjustment box so as to limit the movement of the height adjustment box; a lock holder, which is connected to two side surfaces of an end of the lock so as to change the position of the first bar, thereby allowing the height adjustment box to be moved; and a height adjustment lever for moving the lock holder via a wire, whereby it is possible to adjust the height of the ironing plate and to maintain the height by means of the lock and the lock holder.

The system iron according to the present invention further includes a first elastic member, which is disposed between the lock holder and the first bar so as to apply elastic force to the first bar, whereby it is possible to stably maintain the height of the ironing plate even when external force is applied thereto.

The lock includes the first bar, which is rotated about a hinge shaft and a portion of which projects outwards from the height adjustment box; and a second bar, which is connected at two side surfaces thereof to the lock holder and which moves the position of the first bar by movement of the lock holder, and the height adjustment unit further includes a second elastic member for applying downward elastic force to the second bar, wherein the elastic force of the second elastic member is greater than the elastic force of the first elastic member, thereby allowing preliminary displacement of the height adjustment lever.

Advantageous Effects

First, since the system iron according to the present invention is able to perform both ironing using an iron and garment steaming by means of a single apparatus, there is an advantage in that it is possible to use a single apparatus to perform various ironing operations as required by a user.

Second, since the height adjustment unit according to the present invention includes the elastic member disposed between the lock holder and the first bar, there is an advantage in that it is possible to stably adjust the height of the ironing plate and to maintain the state in which the height is adjusted.

Third, since the height adjustment unit according to the present invention includes the first and second elastic members, there is an advantage in that it is possible to ensure stability in manipulation of the product by providing the safety margin of the height adjustment lever.

BEST MODE

Figure 1:
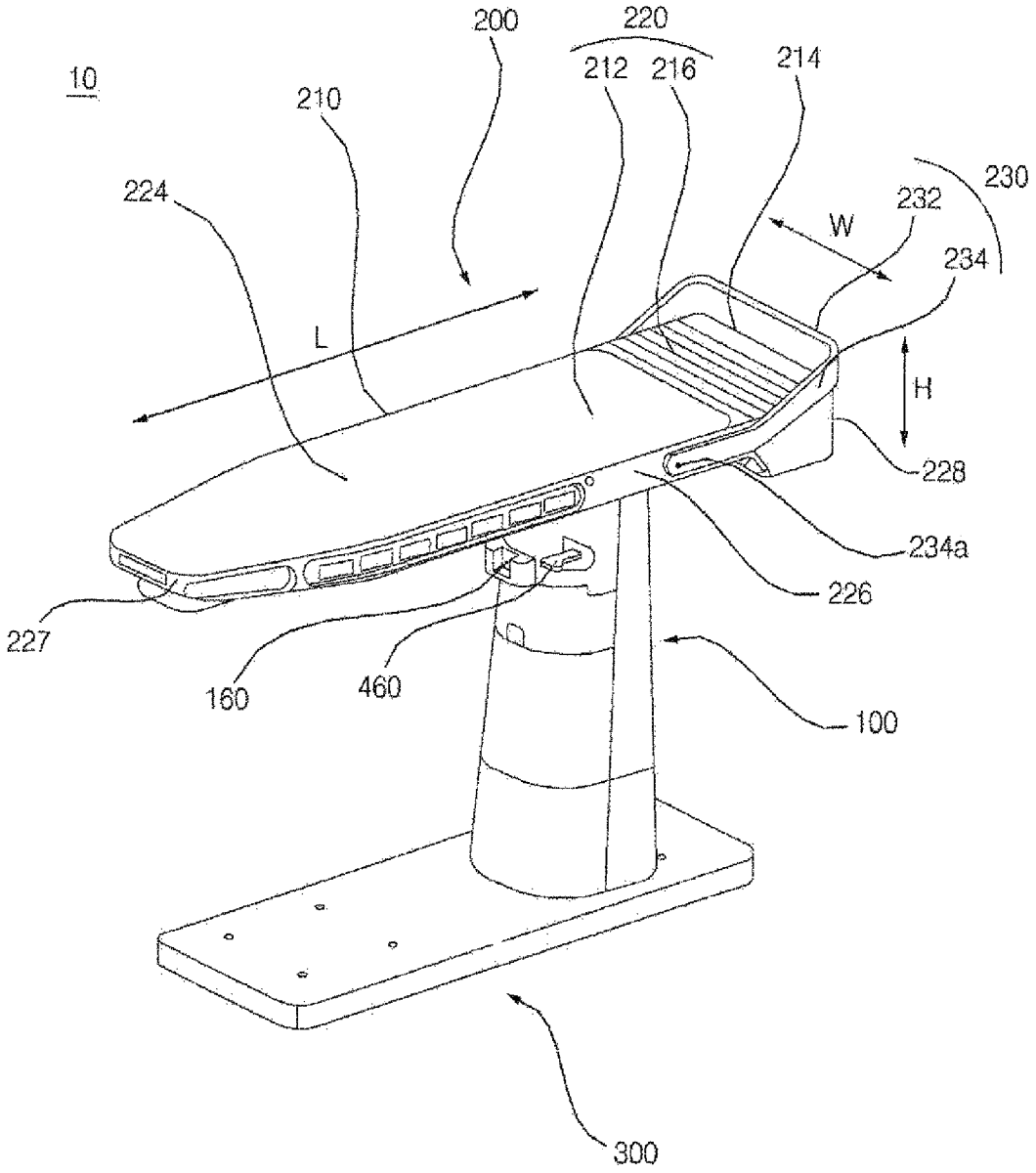
FIG. 1 is a perspective view of a system iron according to an embodiment of the present invention in an ironing mode.

Hereinafter, the present invention will be described with reference to the drawings, which are provided to illustrate a system iron according to embodiments of the present invention.

The system iron 10 according to an embodiment of the present invention includes a body 100 including a steam generator for generating steam; an ironing plate 200 rotatably disposed on the body, on an outer side of which a top is hung and which sprays the steam generated by the steam generator; a spreading unit for tensioning the top hung on the outer side of the ironing plate; a front press 260 for holding the front surface of the top hung on the outer side of the ironing plate; and a pair of arm tensioners 270 for tensioning the sleeves of the top hung on the outer side of the ironing plate.

The system iron 10 according to the embodiment includes a body 100 including therein a steam generator for generating steam; an ironing plate 200 rotatably disposed on the body so as to be changed in position depending on whether the system iron is operated in an ironing mode, in which an ironing operation is performed or in a steam-spraying mode, in which the steam is sprayed to a top; a spreading unit for tensioning the top hung on the outer side of the ironing plate in the steam-spraying mode; a front press 260 for holding the front surface of the top hung on the outer side of the ironing plate in the steam-spraying mode; and a pair of arm tensioners 270 for tensioning the sleeves of the top hung on the outer side of the ironing plate in the steam-spraying mode.

Figure 2:
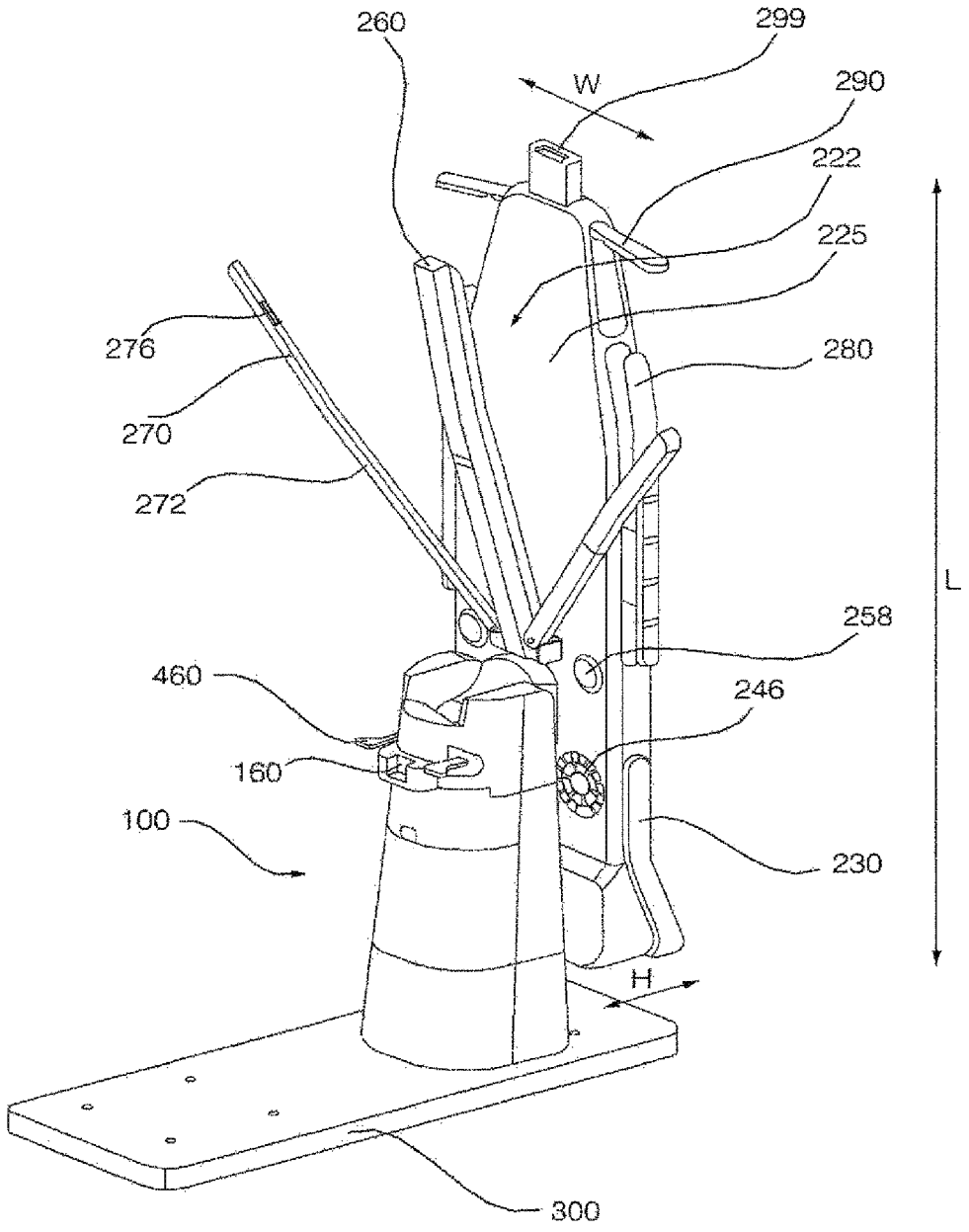
FIG. 2 is a perspective view of the system iron according to an embodiment of the present invention in a steam-spraying mode.
Figure 3:
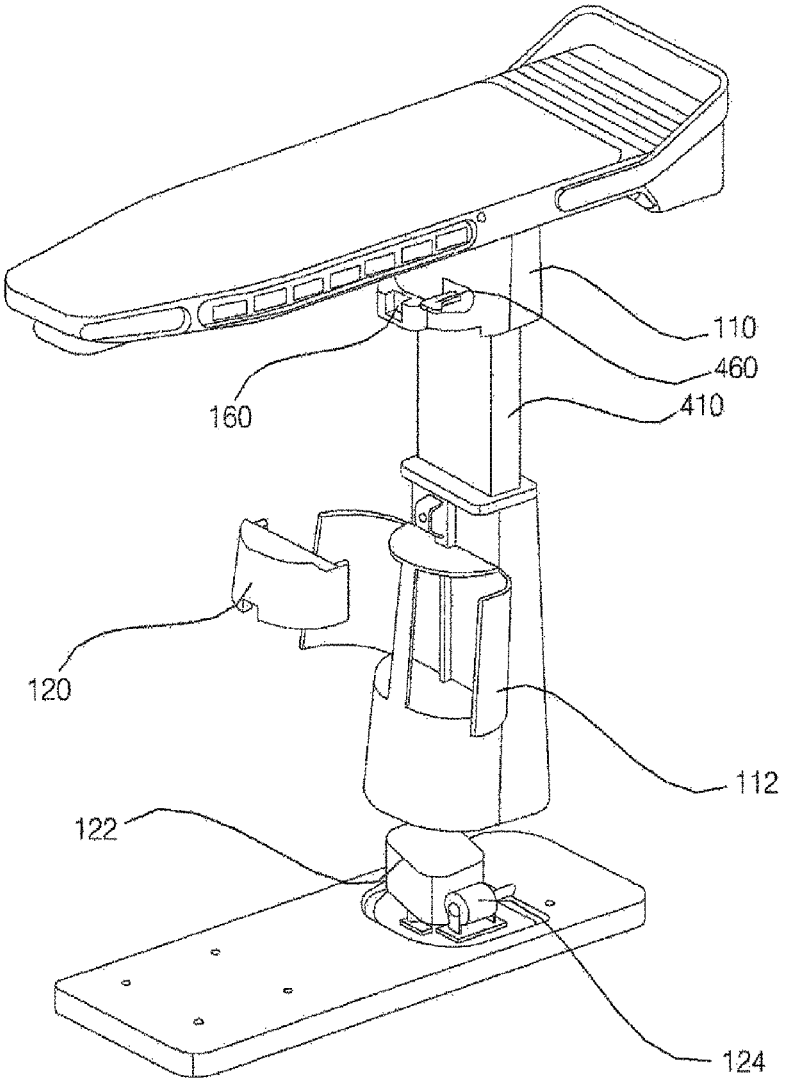
FIG. 3 is an exploded view of the body of the system iron according to an embodiment of the present invention.
Figure 4:
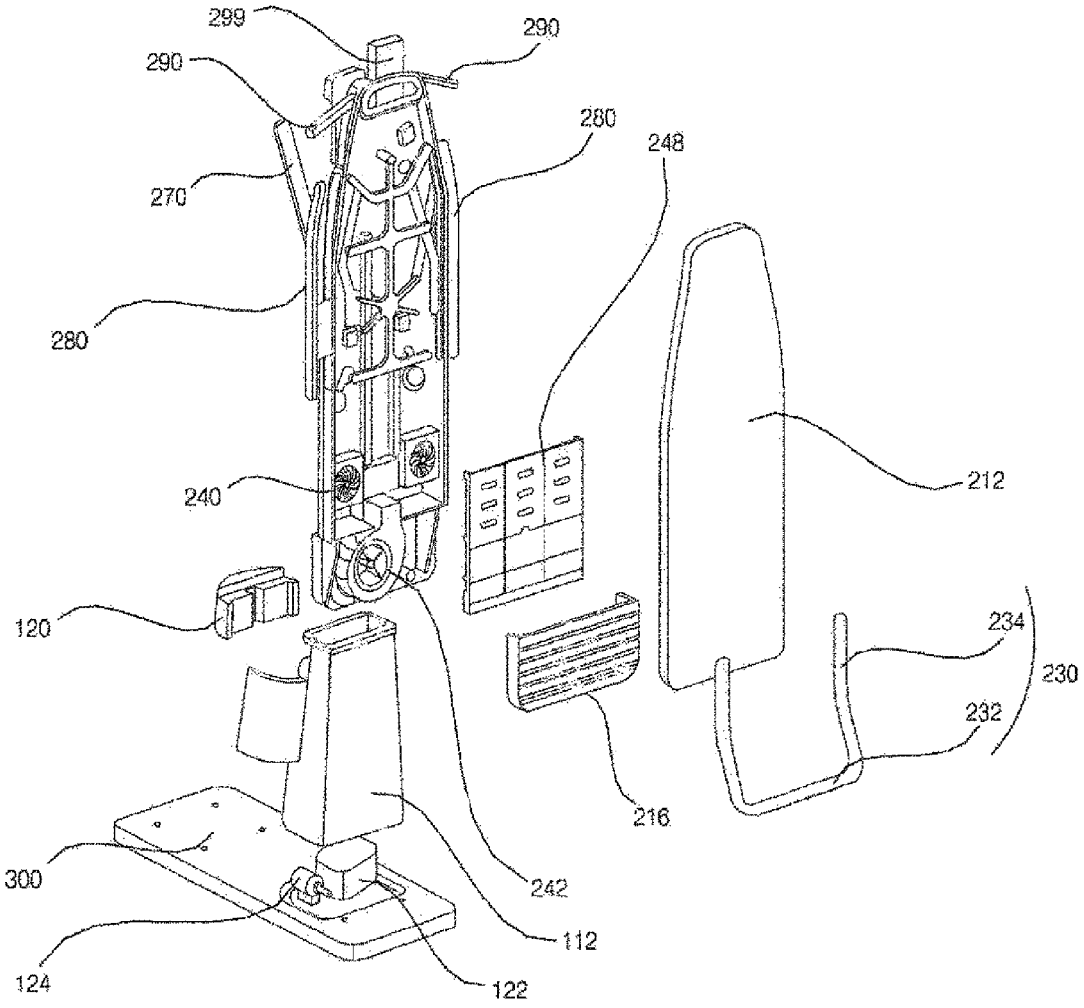
FIG. 4 is an exploded view of the system iron according to an embodiment of the present invention.
Figure 5:
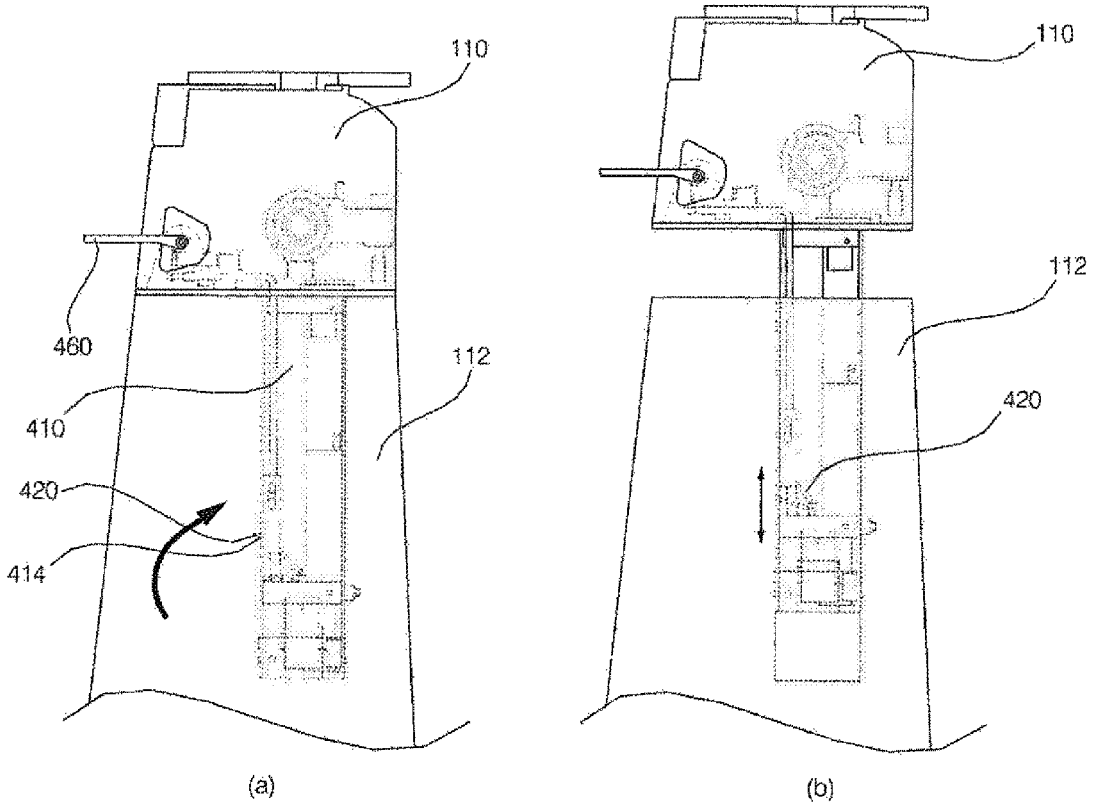
FIG. 5 is a view illustrating a height adjustment unit of the system iron according to an embodiment of the present invention, in which (a) illustrates the state in which an ironing plate is locked and (b) illustrates the state in which the ironing plate is movable.

FIG. 1 is a perspective view of the system iron according to an embodiment of the present invention in an ironing mode. FIG. 2 is a perspective view of the system iron according to an embodiment of the present invention in a steam-spraying mode. FIG. 3 is an exploded view of the body of the system iron according to an embodiment of the present invention. FIG. 4 is an exploded view of the system iron according to an embodiment of the present invention. FIG. 5 is a view illustrating a height adjustment unit of the system iron according to an embodiment of the present invention.

The body of the system iron according to the embodiment will first be described with reference to FIGS. 1 to 5.

The body 100 supports the ironing plate 200, which is connected to the upper side thereof. The body 100 according to the embodiment may be disposed so as to be perpendicular to the ground surface.

The body 100 is configured to have a cylindrical shape, the sectional area of which is decreased moving upwards.

The body 100 includes an upper body 110, to which a rotational member 250 is rotatably coupled, and a lower body 112 for accommodating therein a water tank 120 and the steam generator. The upper body 110 and the lower body 112 are disposed such that the lower surface of the upper body 110 is in contact with the upper surface of the lower body 112. The lower surface of the upper body 110 and the upper surface of the lower body 112 may be disposed so as to be spaced apart from each other by means of the height adjustment unit 400.

The rotational member 250 of the ironing plate 200 is rotatably coupled to the upper side of the upper body 110. The upper body 110 is provided at the upper side thereof with two locking bars 142 for supporting the rotation of a hinge shaft disposed in the rotational member 250. The locking bars 142 are provided therein with circular cavities, in which the hinge shaft 252 is disposed.

The body 100 includes the water tank 120, the steam generator 122 for producing steam from the water stored in the water tank 120, and a vibration pump 124 for supplying the water from the water tank 120 to the steam generator 122. The lower body 112 includes the water tank 120, the steam generator and the vibration pump 124.

The water tank 120 is the space for storing water for generating steam. The water tank 120 is constructed so as to be releasably attached to the body 100. The water tank 120 may be filled with water when separated from the system iron and may then be fitted into the body 100.

The steam generator 122 is a device for generating steam from the water stored in the water tank 120. Some of the water stored in the water tank 120 is introduced into the steam generator 122 by virtue of vibration of the vibration pump 124.

The body 100 according to the embodiment includes therein a steam flow channel 244, which allows steam, generated by the steam generator, to flow to steam nozzles 245 in the ironing plate 200. The steam flow channel 244 according to the embodiment is positioned in the body 100 and the ironing plate 200.

The steam flow channel 244, which is positioned in the system iron according to the embodiment, may be divided into a body steam flow channel, which is positioned in the body, and an ironing plate steam flow channel, which is positioned in the ironing plate. The body steam flow channel and the ironing plate steam flow channel are connected to each other. Steam, which is generated by the steam generator, flows through the body steam flow channel and the ironing plate steam flow channel, and is then discharged from the steam nozzles 245. The steam nozzles 245 are disposed inside the spreading unit of the ironing plate 200. When the spreading unit is spread out to the outside of the ironing plate, the steam nozzles 245 spray steam to the outside.

The body 100 includes the height adjustment unit 400 for adjusting the height of the ironing plate 200. The height adjustment unit 400 adjusts the height of the ironing plate 200 by raising or lowering the upper body 110.

The height adjustment unit 400 includes a height adjustment box 410, which is retracted into the body 100 or is extended to the outside of the body 100 so as to adjust the height of the ironing plate 200, a locking unit for restricting the movement of the height adjustment box 400 and a height adjustment lever 460, which is operated in linkage with the locking unit so as to allow the height adjustment box 410 to be moved.

The height adjustment box 410 according to the embodiment is configured to have a cuboid box shape. The height adjustment box 410 is disposed under the upper body 110. The height adjustment box 410 is retracted into the lower body 112, or is extended upwards from the lower body 112. The height adjustment box 410 is moved upwards and downwards between the outside and the inside of the lower body 112. When the height adjustment box 410 is moved upwards and downwards, the upper body 110 and the ironing plate 200, which are disposed above the height adjustment box 410, are also moved upwards and downwards together with the height adjustment box 410.

The height adjustment box 410 is provided therein with the locking unit for restricting the upward and downward movement of the height adjustment box 410. The height adjustment box 410 is provided in a side surface thereof with a projection hole 414 such that a part of the locking unit projects outwards from the height adjustment box 410 through the projection hole 414.

The locking unit serves to restrict the movement of the height adjustment box 410. The locking unit may be disposed in the height adjustment box 410, and a part of the locking unit may project through the projection hole 414 in the height adjustment box 410. When a projection member of the locking unit projects outwards from the height adjustment box 410, the projection member is engaged with one side of the accommodation space in the height adjustment box 410 at a low position of the body 100, thereby restricting the movement of the height adjustment box 410.

When the part of the locking unit projects outwards through the projection hole 414 in the height adjustment box 410, the height adjustment unit 400 is maintained in the locked state, thereby restricting the upward and downward movement of the height adjustment box 410. When the projection member of the locking unit does not project outwards through the projection hole 414 in the height adjustment box 410, the height adjustment unit 400 is released from the locked state, thereby allowing upward and downward movement of the height adjustment box 410.

The locking unit is operated in linkage with the height adjustment lever 460. A user may switch the height adjustment unit 400 between the locked state and the released state using the height adjustment lever 460. A user may cause the projection member of the locking unit to project outwards from the height adjustment box 410 or to be retracted into the height adjustment box 410 using the height adjustment lever 460. A user may move the height adjustment box 410 using the height adjustment lever 460.

The height adjustment lever 460 is disposed at the upper body 110. The height adjustment lever 460 may be connected to the locking unit. The height adjustment lever 460 may cause the projection member of the locking unit to project to the outside of the height adjustment box 410 or to be disposed in the height adjustment box 410 using a wire.

The height adjustment unit 400 according to the embodiment is constructed such that, when the height adjustment lever 460 is rotated upwards about a lever shaft 138*a* as shown in FIG. 5(*a*), the locking unit is released, thereby allowing the height adjustment box 410 to be moved upwards and downwards as shown in FIG. 5(*b*).

The body according to the embodiment includes the support-leg mount 160, on which a support leg 266 (see FIG. 11) of a support unit of the ironing plate 200, which will be described later, is mounted. The support-leg mount 160 is the portion formed at the upper body 110, on which one end of the support leg 266 is mounted.

Figure 6:
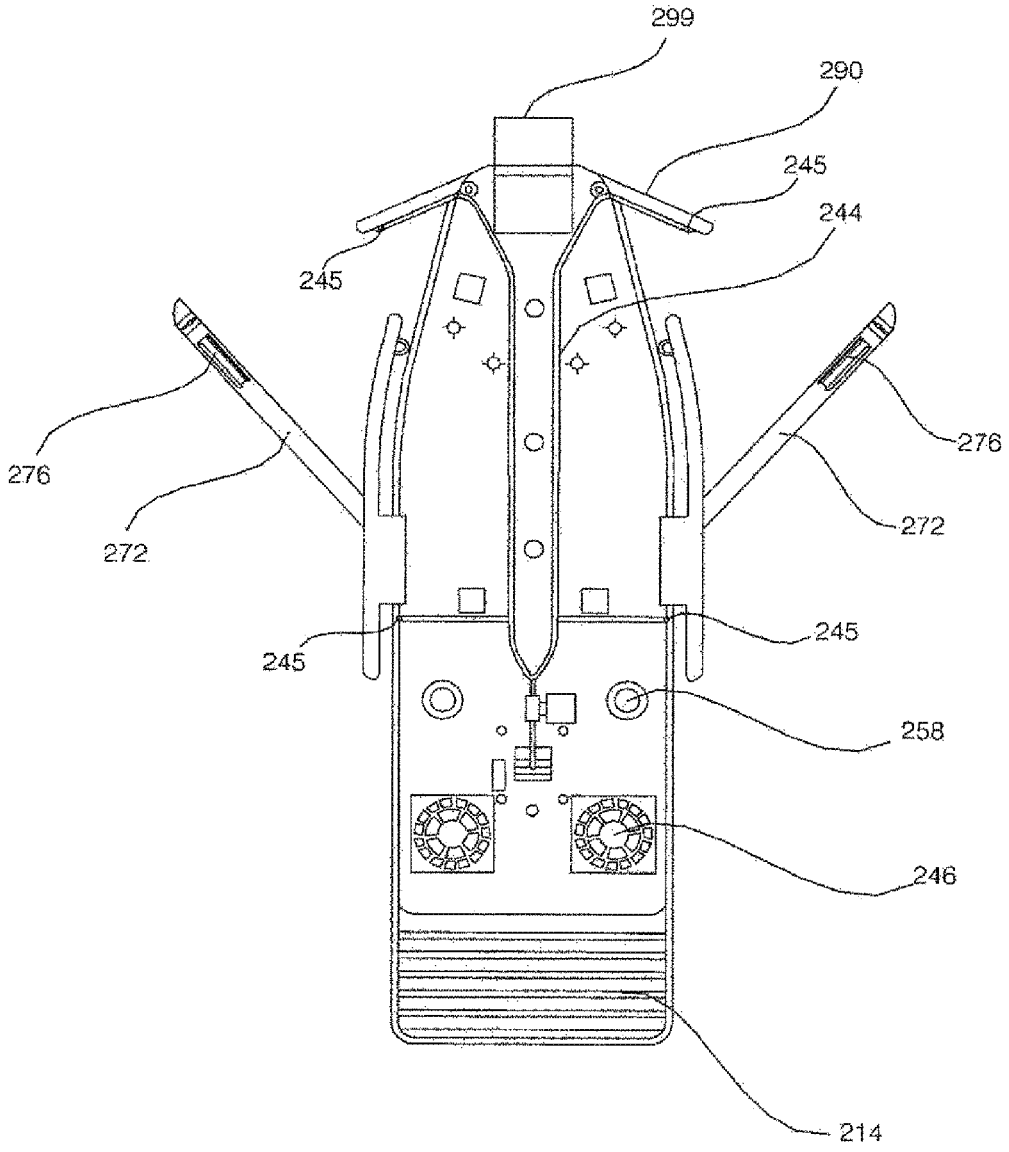
FIG. 6 is a view showing a planar surface of the ironing plate from which a clothing-ironing plate and a first fan have been removed in order to show the steam flow channel and the steam nozzles of the system iron according to an embodiment of the present invention.
Figure 7:
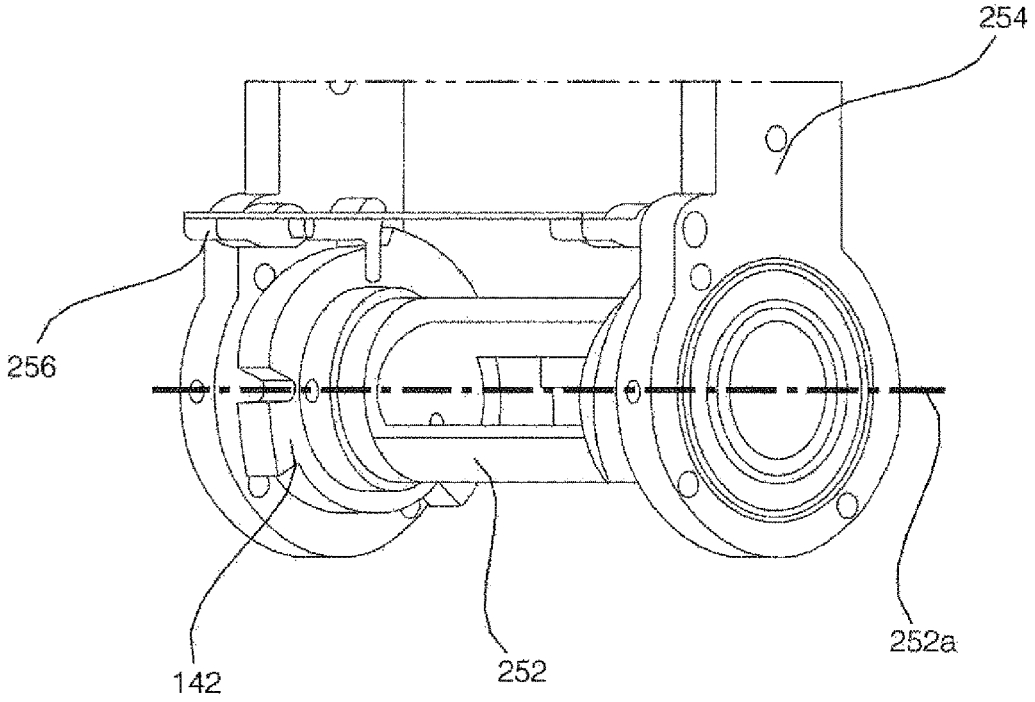
FIG. 7 is a view illustrating a hinge shaft and an angle-limiting unit in the rotational member, which are intended to rotate or lock the ironing plate of the system iron according to an embodiment of the present invention.

FIG. 6 is a view showing the planar surface of the ironing plate from which a clothing-ironing plate and a first fan are removed in order to show the steam flow channel and the steam nozzles of the system iron according to an embodiment of the present invention. FIG. 7 is a view illustrating a hinge shaft and an angle-limiting unit in the rotational member, which are intended to rotate or lock the ironing plate of the system iron according to an embodiment of the present invention.

Hereinafter, the ironing plate of the system iron will be described with reference to FIGS. 1 to 4, FIG. 6 and FIG. 7.

The ironing plate 200 according to the embodiment is a plate functioning to iron clothing or to spray steam on clothing hung on the outer side of the ironing plate 200. The ironing plate 200 is rotatably coupled to the upper side of the body 100.

The ironing plate 200 according to the embodiment is changed in position depending on the mode in which the ironing plate 200 is used. As shown in FIG. 1, the system iron 10 according to the embodiment may be operated in the ironing mode in which clothing is ironed using an iron, as shown in FIG. 1, or in the steam-spraying mode, in which a top is hung on the outer side of the ironing plate 200 and steam is sprayed to the top hung on the ironing plate 200, as shown in FIG. 2.

The ironing plate 200 according to the embodiment is disposed parallel to the ground surface in the ironing mode and is disposed perpendicular to the ground surface in the steam-spraying mode. The ironing plate 200 according to the embodiment is disposed perpendicular to the body 100 in the ironing mode and is disposed parallel to the body 100 in the steam-spraying mode.

The ironing plate 200 according to the embodiment is rotated about a rotational axis 252*a* (see FIG. 7), which is provided at the upper portion of the upper body 110. The ironing plate 200 is rotated about the rotational axis 252*a*, which is provided at the locking bars 142 of the upper body 110, so as to be changed in position depending on whether the system iron is operated in the ironing mode or in the steam-spraying mode. The ironing plate 200 according to the embodiment is constructed so as to be rotated within a range of 0 to 90 degrees when the operational mode is changed between the ironing mode and the steam-spraying mode. However, this is merely one example, and the ironing plate 200 may be set to be rotated within an angular range of 0 to greater than 90 degrees.

In the description of the ironing plate 200 according to the embodiment, on the basis of FIG. 1, the surface of the ironing plate 200 that is connected to the body 100 is referred to as a lower surface 225, the surface of the ironing plate 200 that is opposite the lower surface 225 and on which clothing is ironed in the ironing mode is referred to as an upper surface 224, the surfaces of the ironing plate 200, on which side tensioners 280 and shoulder tensioners 290 are disposed, among the surfaces connecting the upper surface 224 and the lower surface 225, are referred to as side surfaces 226, the surface of the ironing plate 200, on which a neck clip 299 is disposed and which is adjacent to portions at which the shoulder tensioners 290 are disposed, among the surfaces connecting the upper surface 224 and the lower surface 225, is referred to as a front surface 227, and the surface of the ironing plate 200 that is opposite the front surface 227, among the surfaces connecting the upper surface 224 and the lower surface 225, is referred to as a rear surface 228.

In addition, on the basis of FIG. 1, a linear direction in which the neck clip is connected to an iron rest is referred to as a longitudinal direction L, a linear direction in which the side tensioners 280, which are disposed at the two side surfaces 226 of the ironing plate 200, are connected to each other is referred to as a width direction W, and a linear direction in which the upper surface 220 and the lower surface 225 of the ironing plate 200 are connected to each other is referred to as a height direction H. In the longitudinal direction L, the direction toward the front surface 227 is referred to as a forward direction, and the direction opposite the forward direction and toward the lower surface 225 is referred to as a rearward direction. In the height direction H, the direction that the upper surface 224 of the ironing plate 200 faces is referred to as an upward direction, and the direction that the lower surface 225 faces is referred to as a downward direction. The longitudinal direction L, the width direction W and the height direction H define relationships such that they are perpendicular to one another. These definitions may be used in the description of the ironing plate 200, and may be similarly used whether the operation mode is changed to the ironing mode as shown in FIG. 1 or to the steam-spraying mode as shown in FIG. 2. These definitions of direction are merely for illustration of the present invention and do not restrict the scope of the present invention.

The ironing plate 200 according to the embodiment includes an ironing-plate case 222, which defines the appearance of the ironing plate 200 and which is open at the upper plane 224, and an upper plate 220 disposed on the upper plane of the ironing plate 200. The ironing-plate case 222 and the upper plate 220 define the appearance of the ironing plate 200. The ironing-plate case 222 defines the lower surface 225, the side surfaces 226, the front surface 227 and the rear surface 228 of the ironing plate 200. The ironing-plate case 222 is coupled at the lower surface 225 to the body 100.

The upper plate 220 includes a clothing-ironing plate 212 disposed on a clothing-ironing board 210, which will be described later, and an iron-resting plate 216 disposed on an iron rest 214.

The ironing plate 200 according to the embodiment includes the clothing-ironing board 210, which is used to iron clothing in the ironing mode or on which clothing is hung in the steam-spraying mode, and the iron rest 214 on which the iron is placed in the ironing mode. The clothing-ironing board 210 is disposed at the front part of the ironing plate 200 in the longitudinal direction L, and the iron rest 214 is disposed at the rear part of the ironing plate 200 in the longitudinal direction L.

The clothing-ironing board 210 is a part on which clothing is hung so as to be ironed using an iron in the ironing mode. The clothing-ironing board 210 is a part on which clothing is hung in the steam-spraying mode. The clothing-ironing board 210 is configured so as to have a shape similar to a typical ironing plate 200 having a surface area which is reduced moving forwards in the longitudinal direction L of the ironing plate 200. The upper plane of the clothing-ironing board 210 is provided with the clothing-ironing plate 212, in which a through hole is formed so as to allow the air inside the ironing plate 200 and the air outside the ironing plate 200 to communicate with each other. The clothing-ironing board 210 is provided therein with a first fan 240, which is intended to suck air into the inside of the ironing plate 200 or to discharge air to the outside of the ironing plate 200 through the through hole formed in the clothing-ironing plate 212. The first fan 240 may be rotated in a forward direction or a reverse direction. The first fan 240 may be embodied by an axial fan.

The first fan 240 serves to suck air through the through hole in the clothing-ironing plate 212 in the ironing plate or serves to discharge air through the through hole in the clothing-ironing plate 212 in the steam-spraying mode. An opening hole 246 is formed in a lower portion of the ironing-plate case 222 so as to allow air to flow to the inside and outside of the ironing plate 200 by virtue of the first fan 240.

The clothing-ironing board 210 is provided therein with a guide plate 248 for guiding air, which flows by means of the first fan 240, toward the through hole.

The clothing-ironing board 210 includes the steam nozzles 245 for spraying steam, which is generated by the steam generator 122, toward the outside. The steam nozzles 245 receive steam, which is generated by the steam generator 122, through the steam flow channel 244. In the steam-spraying mode, steam, which is generated by the steam generator 122, is sprayed through the steam nozzles 245 disposed in the clothing-ironing board 210.

The iron rest 214 is a zone on which the iron, which is used in the ironing mode, is placed. The iron rest 214 is provided on the upper plane 224 with the iron-resting plate including a plurality of suction holes through which air flows. The iron rest 214 is provided therein with a second fan 242 so as to suck air through the plurality of holes formed in the iron-resting plate 216. The second fan 242 is preferably embodied by a sirocco fan, which causes the direction of air suction to be perpendicular to the direction of air discharge. When the second fan 242 is activated, air is sucked into the iron-resting plate 216 and is then discharged to the inside of the clothing-ironing board 210.

A silicone insulation material is disposed on the iron-resting plate 216. Accordingly, even when a high temperature iron, which is in use, is placed on the iron rest 214, it is possible to prevent a fire and contamination of the heating plate of the iron by virtue of provision of the silicone insulation material. In addition, it is possible to rapidly cool the iron, upon termination of use thereof, by activating the second fan 242 in the iron rest 214.

The ironing plate 200 may further include an iron protector 230 for preventing the iron, which is placed on the iron rest, from falling out of the iron rest. The iron protector 230 is configured so as to have a 'U' shape. The two ends of the iron protector 230 are rotatably disposed at the two side surfaces 226 of the ironing plate 200.

The iron protector includes a horizontal bar 232, which is positioned outside the iron rest so as to prevent the iron from escaping from the iron rest, and a pair of vertical bars 234, which are bent from the two ends of the horizontal bar 232 in a direction perpendicular thereto and which allow the horizontal bar 232 to be moved.

The pair of vertical bars 234 are connected at first ends thereof to the two ends of the horizontal bar 232, and are rotatably connected at the second ends thereof to the two side surfaces 226 of the ironing plate 200. The vertical bars 234 are rotated about rotational shafts 234*a* formed on the two side surfaces 226 of the ironing plate 200. As the vertical bars 234 are rotated, the position of the horizontal bar 232 is changed. Referring to FIG. 1, the horizontal bar 232 is positioned outside the iron rest in the ironing mode, thereby preventing the iron from escaping to the outside of the iron rest.

The iron protector 230 may hold a rear portion of a top, which is hung on the ironing plate 200, in the steam-spraying mode. The iron protector 230 holds a rear surface of a top, which is hung on the outer side of the ironing plate 200. The horizontal bar 232 is held on the clothing-ironing plate 212 in the steam-spraying mode, thereby holding a rear surface 228 of a top, which is hung on the ironing plate 200. The horizontal bar 232 may include a magnetic material. In the steam-spraying mode, the horizontal bar 232 is detachably attached to the clothing-ironing board 210 by virtue of the magnetic material.

The ironing plate 200 includes the rotational member 250, which is rotatably coupled to the body 100, a holding unit for holding a top, hung on the ironing plate 200, in the steam-spraying mode, and the spreading unit for tensioning the top hung on the ironing plate 200 in the steam-spraying mode. The clothing-ironing board 210 includes the rotational member 250, the holding unit and the spreading unit.

The rotational member 250 projects from the lower surface 225 of the ironing-plate case 222. The rotational member 250 is disposed at the upper portion of the body 100. The rotational member 250 is configured to have a shape complementary to the upper portion of the body 100 such that the rotational member 250 is rotatable at the upper portion of the body 100.

Referring to FIG. 7, the rotational member 250 is rotated about the rotational axis 252*a*, which is formed between the body 100 and the rotational member. The rotational member 250 includes a hinge shaft 252, which is rotated about the rotational axis 252*a*, and connecting bars 254 connecting the hinge shaft 252 to the ironing plate 200. The rotational member 250 further includes an angle-limiting unit 256 for limiting rotation of the hinge shaft 252 and a button unit 258, which is operated in linkage with the angle-limiting unit 256 so as to allow rotation of the hinge shaft 252.

The hinge shaft 252 is disposed in the cavities in the two locking bars 142. The hinge shaft 252 is rotated in the cavities in the locking bars 142. The connecting bars 254 are disposed at the two ends of the hinge shaft 252. The connecting bars 254 transmit the rotating force of the hinge shaft 252 to the ironing plate 200. When the hinge shaft 252 is rotated, the connecting bars 254 are rotated about the rotational axis 252*a*, thereby rotating the ironing plate 200. The connecting bars 254 are provided with the angle-limiting unit 256 for limiting rotation of the hinge shaft 252.

The angle-limiting unit 256 is rotated with the connecting bars 254. The locking bar 142 is provided with a plurality of locking grooves into which the angle-limiting unit 256 is inserted. A part of the angle-limiting unit 256 is inserted into one of the plurality of locking grooves formed in the locking bar 142, thereby locking the ironing plate 200. When the angle-limiting unit 256 is inserted into one of the plurality of locking grooves in the locking bar 142, rotation of the hinge shaft 252 is limited.

Figure 8:
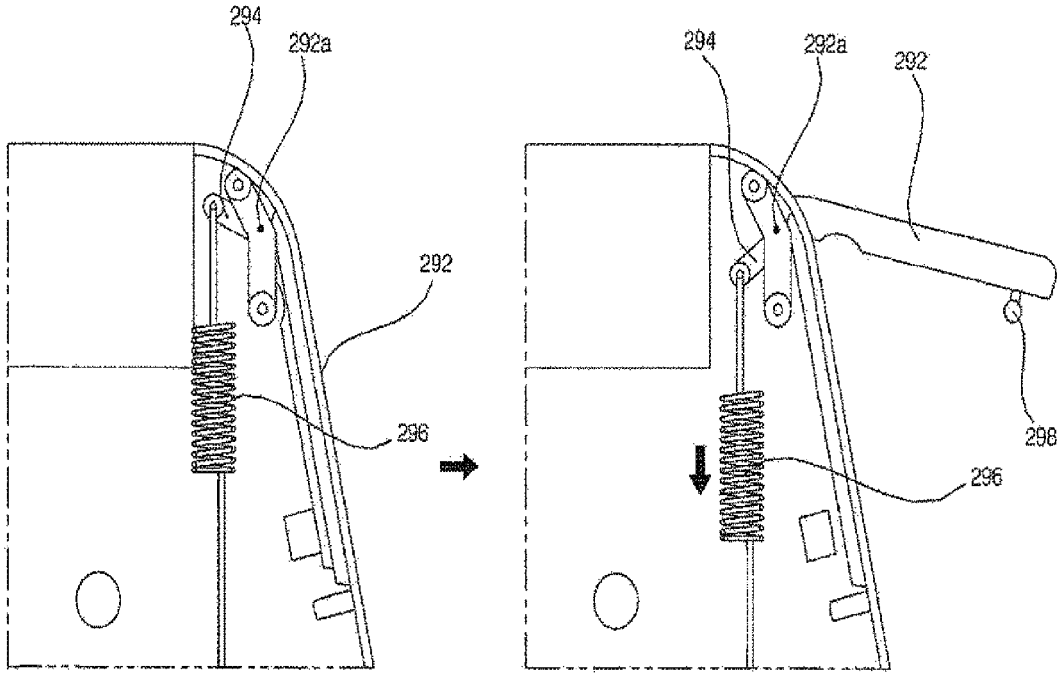
FIG. 8 is a view illustrating shoulder tensioners of the system iron according to an embodiment of the present invention.

The angle-limiting unit 256 is operated in linkage with the button unit 258. Referring to FIGS. 2 and 8, in the ironing plate 200 according to the embodiment, when the button unit 258 is pushed, the angle-limiting unit 256 is separated from the groove in the locking bar 142. When the button unit 258 is pushed by a user, the hinge shaft 252 is allowed to be moved.

The holding unit is a member for holding a top hung on the ironing plate 200 in the steam-spraying mode. The holding unit includes a magnetic material. The holding unit is detachably attached to the ironing plate 200 by virtue of the magnetic material. The holding unit includes a front press 260 for holding the front surface 227 of a top and the iron protector 230 for holding the rear surface 228 of the top.

The front press 260 serves to hold a top hung on the ironing plate 200 in the steam-spraying mode. The front press 260 is disposed under the lower surface 225 of the ironing plate 200 and extends in the longitudinal direction L of the ironing plate 200. The front press 260 brings the front surface of the top, hung on the ironing plate 200, into close contact with the lower surface 225 of the ironing plate 200 in the steam-spraying mode. The front press 260 brings the front surface of the top, hung on the outer side of the ironing plate 200, into close contact with the lower surface 225 of the ironing plate 200. The front press 260 is detachably attached to the lower surface 225 of the ironing plate 200 by virtue of the magnetic material. The detachable attachment of the front press using the magnetic material is merely one example, and another member, which functions to hold the front surface of the top between the lower surface of the ironing plate 200 and the front press 260, may also be used.

The magnetic force, which is created between the front press 260 and the ironing plate 200 so as to hold the front surface of the top hung on the outer side of the ironing plate, is set to be greater than the force exerted by the side tensioners 280 so as to spread the side surfaces of the top.

The front press 260 is disposed under the lower surface 225 of the ironing-plate case 222. The front press is hingedly coupled to the ironing plate 200 so as to be detachably attached to the lower surface of the ironing plate 200. The front press 260 is rotated about a press-plate hinge 264, which is provided at one side of the front press 260. The press-plate hinge 264 is disposed on the lower surface 225 of the ironing-plate case 222 so as to be positioned in front of and adjacent to the rotational member 250 in the longitudinal direction L of the ironing plate 200.

The front press 260 includes a press plate 262, which comes into contact with the ironing-plate case 222, and the press-plate hinge 264, which serves to hingedly couple the press plate 262 to the ironing plate 200. The press plate 262 comes into contact with the lower surface 225 of the ironing-plate case 222. The front press 260 is disposed adjacent to the rotational member 250 and extends in the longitudinal direction L of the ironing plate 200. The press-plate hinge 264 is disposed at the end of the front press 260 adjacent to the rotational member 250. The press-plate hinge 264 includes a rotational shaft 264*a*, which extends parallel to the width direction W of the ironing plate 200 so as to allow the press plate 262 to be rotated thereabout.

A top, which is hung on the ironing plate 200, is disposed between the press plate 262 and the ironing-plate case 222. The top, which is hung on the ironing plate 200, is held between the press plate 262 and the ironing-plate case 222.

Figure 9:
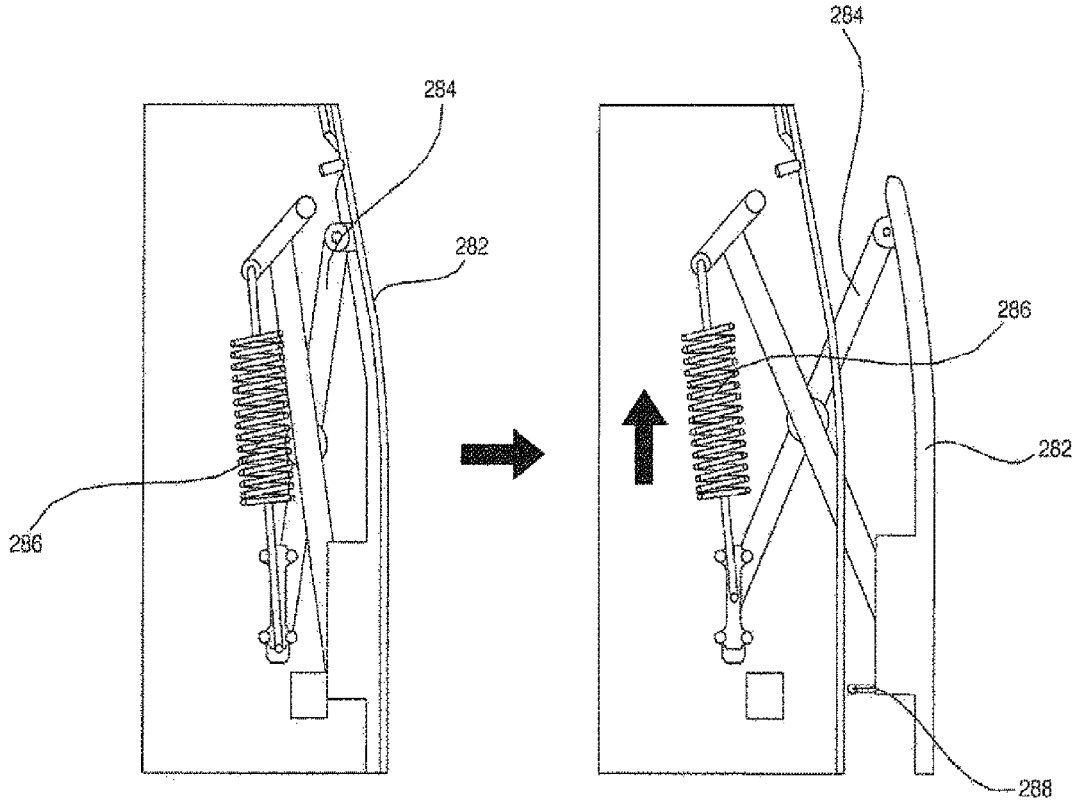
FIG. 9 is a view illustrating side tensioners of the system iron according to an embodiment of the present invention.

FIG. 8 is a view illustrating the shoulder tensioners of the system iron according to an embodiment of the present invention. FIG. 9 is a view illustrating the side tensioners of the system iron according to an embodiment of the present invention. Hereinafter, the side tensioners and the shoulder tensioners, which constitute the spreading unit, will be described with reference to FIGS. 8 and 9.

The spreading unit tensions a top, which is hung on the ironing plate 200, in order to eliminate wrinkles in the top. The spreading unit includes the side tensioners 280 for tensioning the right and left sides of the top and the shoulder tensioners 290 for holding shoulder portions of the top and for tensioning the same.

The side tensioners 280 and the shoulder tensioners 290 are intended to tension the right and left sides of the top and the two shoulder portions of the top. The side tensioners 280 are composed of a pair of right and left tensioners, and the shoulder tensioners 290 are composed of a pair of right and left tensioners, which are symmetrical with each other.

Referring to FIG. 9, the pair of side tensioners 280 uniformly tension the right and left sides of the top hung on the ironing plate 200 in order to eliminate wrinkles in the top. The pair of side tensioners 280 are disposed at the two side surfaces 226 of the ironing plate 200. Each of the pair of side tensioners 280 includes a side bar 282, which comes into contact with the inner surface of the top, a support member 284 for linearly moving the side bar 282 outwards from the ironing plate 200 in the width direction W in a reciprocating manner, an elastic member 286 for exerting compressive force on the ends of the support member 284, and a one-touch click button 288 for holding the side bar 282 at the side surface 226.

The support member 284 according to the embodiment is configured to have an 'X' shape, and is vertically moved at first ends thereof by means of the elastic member, thereby moving the side bar 282 in the lateral direction of the ironing plate 200. The elastic member 286 according to the embodiment is embodied as a spring for exerting compressive force on the ends of the support member. The elastic member 286 may be replaced with any another member capable of exerting compressive force.

A user may release the locked state of the one-touch click button 288 by pushing the side bar 282. When the locked state of the one-touch click button 288 is released, the compressive force of the elastic member 286 is applied to the support member 284, and the side bar 282 is thus moved outwards from the side surface 226 of the ironing plate 200.

Referring to FIG. 8, the pair of shoulder tensioners 290 tension the two shoulder portions of the top. The shoulder tensioners 290 serve to enable the top to be stably hung on the ironing plate 200. The shoulder tensioners 290 are respectively rotated about hinge shafts 292*a*, which are formed at regions adjacent to the front surface 227 of the ironing plate 200. The pair of shoulder tensioners 290 are disposed at the two side surfaces 226 of the ironing plate 200 so as to be positioned at the front side in the longitudinal direction L of the ironing plate 200. The pair of shoulder tensioners 290 are spread from the two side surfaces 226 of the ironing plate 200 forwards in the longitudinal direction L of the ironing plate 200.

Each of the pair of shoulder tensioners 290 includes a hanger 292 for supporting the shoulder portions of the top hung on the outer side of the ironing plate, an elastic member 296 for spreading the hanger 292 outwards and forwards from the ironing plate 200, and a one-touch click button 298 for locking the hanger 292 so as to be held at the side surface 226 and for releasing the locked state of the hanger 292.

The hanger 292 is disposed at the front side of the side surface 226 of the ironing plate 200. The elastic member 296 exerts compressive force on the end of the hanger 292. The elastic member may be embodied by a member such as a spring.

The hanger 292 includes a hanger projection, which is bent at one end of the hanger 292 and extends to the inside of the ironing plate 200. The hanger projection 294 is connected at one end thereof to the hanger 292, and is connected at the other end thereof to the elastic member 296. The hanger projection 294 is provided between the two ends thereof with a hinge shaft 292*a*, about which the hanger 292 is rotated.

When a user pushes the lower portion of the hanger 292, the locked state of the one-touch click button 298 is released. When the locked state of the one-touch click button 298 is released, the other end of the projection of the hanger 292 is pulled by means of the compressive force of the elastic member 296. Due to the rotation of the hanger projection 294, the hanger 292 is projected outwards from the side surface 226. When the locked state of the one-touch click button 298 is released, the hanger 292 tensions the shoulder portions of the top hung on the ironing plate 200.

Figure 10:
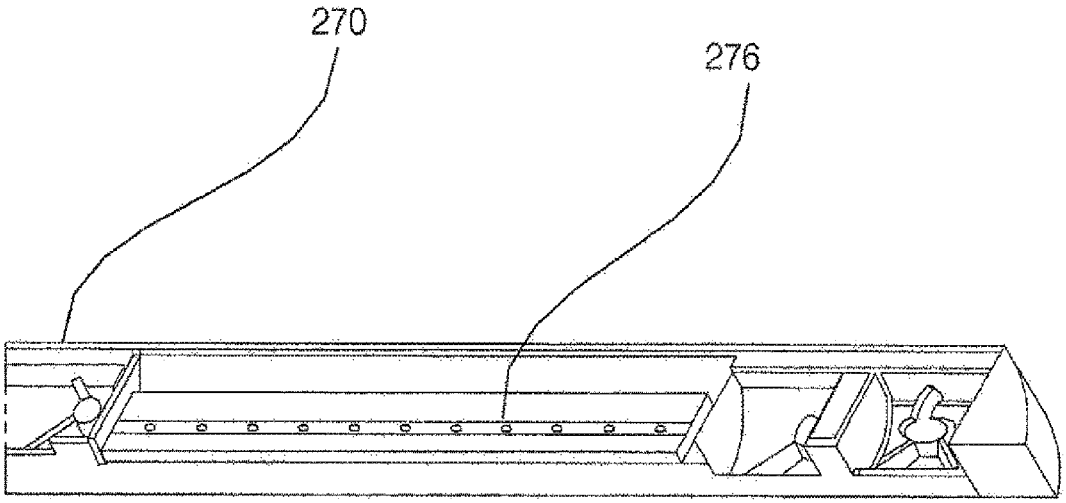
FIG. 10 is a view illustrating an arm tensioner including a sleeve-holding unit according to an embodiment of the present invention.

FIG. 10 is a view illustrating the arm tensioner including a sleeve-holding unit according to an embodiment of the present invention.

Hereinafter, the arm tensioners will be described. The pair of arm tensioners 270 serve to hold the two sleeve portions of the top hung on the ironing plate 200 and to tension the same in order to eliminate wrinkles in the two sleeve portions of the top. The arm tensioners 270 are also composed of a pair of tensioners, which are symmetrical to each other, so as to tension the two sleeves of the top. The arm tensioners 270 tension the sleeves of the top by pulling the sleeves of the top. The pair of arm tensioners 270 are disposed under the press plate 262 of the front press 260 in the height direction H of the ironing plate 200. When the press plate 262 is rotated about the press-plate hinge 264, the arm tensioners 270 are also rotated therewith. The arm tensioners 270 are rotated about the arm-tensioner hinges 274, thereby tensioning the sleeves of the top.

Each of the pair of arm tensioners 270 includes an arm-tension bar 272, which is hingedly coupled at one end thereof so as to be rotated on the lower surface of the ironing plate, and a sleeve-holding unit 276, which is disposed at the other end of the arm-tension bar so as to hold the sleeve of the top hung on the outer side of the ironing plate. The two rear ends of the pair of arm tensioners 270 are hingedly coupled to the lower surface of the front press 260, and the two front ends of the pair of arm tensioners 270 are rotated far away from each other.

The arm-tension bars 272 are rotated so as to tension the sleeves of the top. The arm tensioners 270 further include the arm-tensioner hinges 274, which allow the arm-tension bars 272 to be rotated.

The rotational shafts 274*a* of the arm-tensioner hinges 274 are configured so as to be perpendicular to the press plate 262. The rotational shafts 274*a* of the arm-tensioner hinges are configured so as to be perpendicular to the rotational shaft 264*a* of the press-plate hinge 264. Each of the arm-tension bars 272 is provided at one end thereof with the arm-tensioner hinge 274, and is provided at the other end thereof with the sleeve-holding unit 276. The pair of arm-tensioner hinges 274 allow the arm-tension bars 272 to be rotated such that portions thereof at which the sleeve-holding units 276 are positioned are moved far away from each other.

Figure 11:
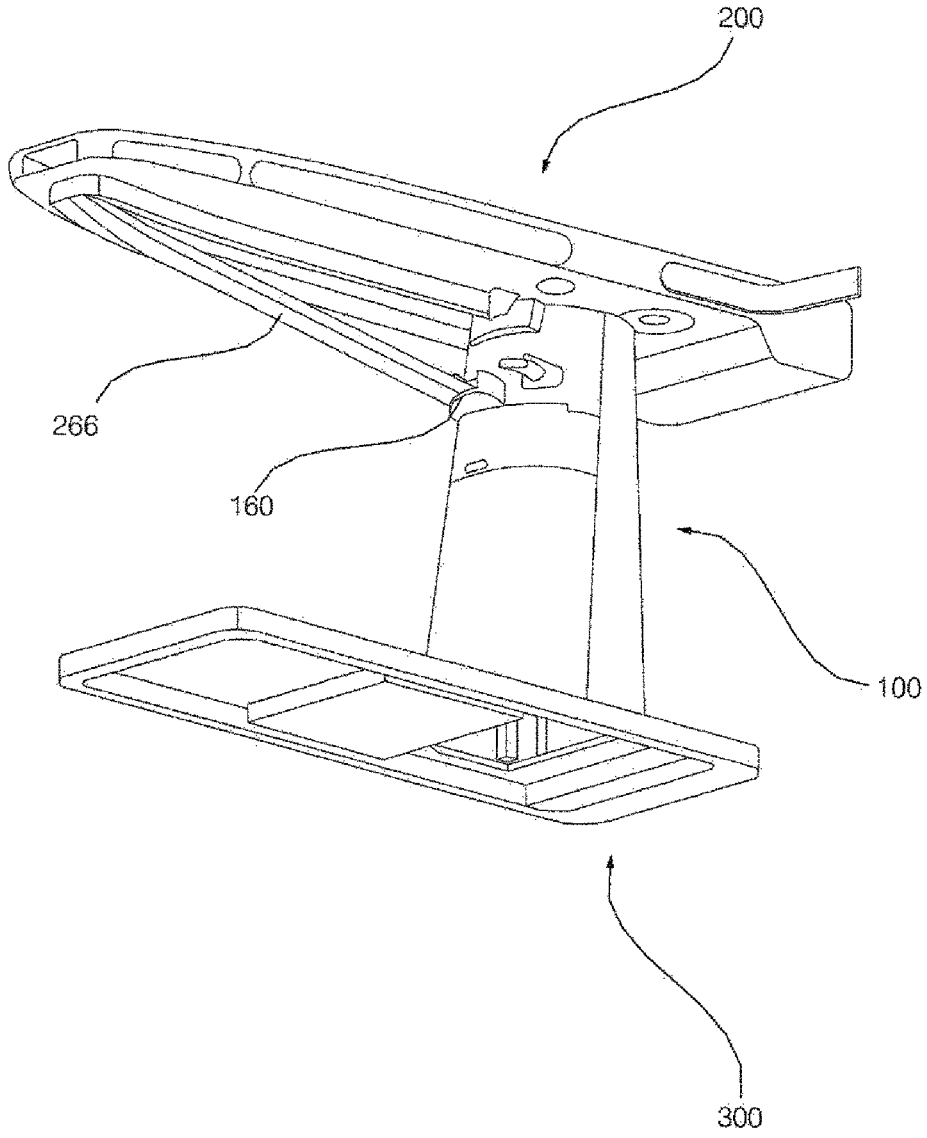
FIG. 11 is a bottom perspective view of the system iron according to an embodiment of the present invention, in which a support member is mounted on a support-leg mount.
Figure 12:
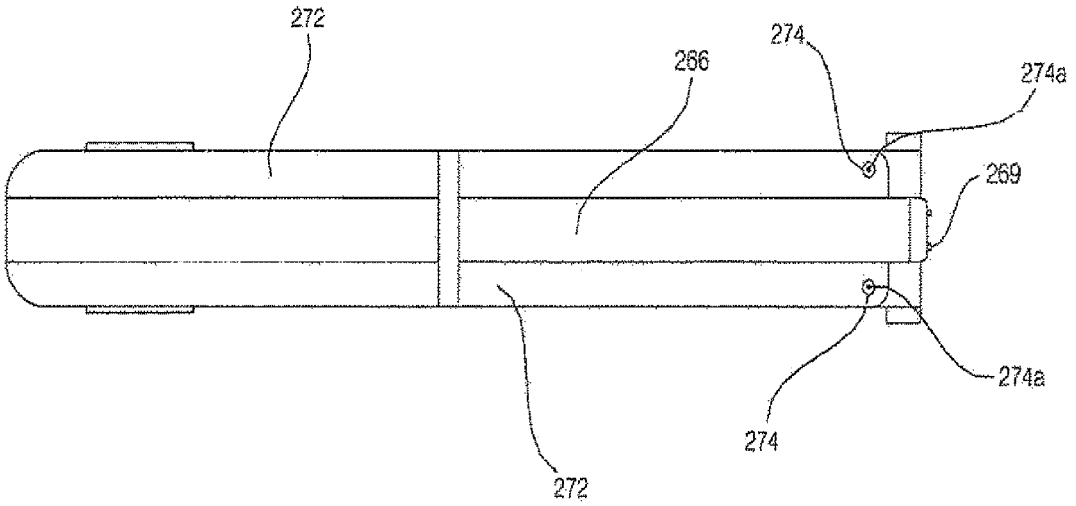
FIG. 12 is a view illustrating a front press, the arm tensioners and a support leg of the system iron according to an embodiment of the present invention.
Figure 13:
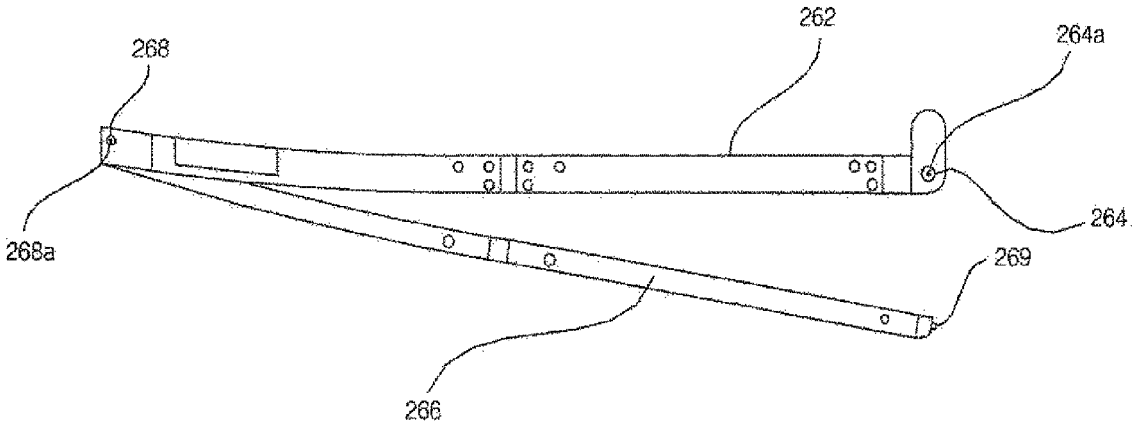
FIG. 13 is a view illustrating the front press, the arm tensioners and the support leg according to an embodiment of the present invention.

FIG. 11 is a bottom perspective view of the system iron according to an embodiment of the present invention, in which the support member is mounted on the support-leg mount. FIG. 12 is a view illustrating the front press, the arm tensioners and the support leg according to an embodiment of the present invention. FIG. 13 is a view illustrating the front press, the arm tensioners and the support leg according to an embodiment of the present invention.

The support unit according to the embodiment will be described with reference to FIGS. 11 to 13. The system iron according to the embodiment further includes the support unit for supporting the ironing plate 200 in the ironing mode. The support unit supports the ironing plate 200, which is vertically disposed on the body 100, in the ironing mode. The support unit supports the lower surface 225 of the ironing-plate case 222 in the ironing mode. The support unit connects the lower surface 225 of the ironing-plate case 222 and the support-leg mount formed on a side surface of the upper body 110 in the ironing mode. The support unit supports the clothing-ironing board 210 of the ironing plate 200.

The support unit includes the support leg 266, which supports the ironing plate 200 in the ironing mode, and a support-leg hinge 268, which enables the support leg 266 to be rotated. The support leg 266 is disposed under the press plate 266 of the front press 260 in the height direction H of the ironing plate 200. The support leg 266 according to the embodiment is disposed between the pair of arm tensioners 270. The support-leg hinge 268 is disposed at the front side of the support leg 266 in the longitudinal direction L of the ironing plate 200.

The arm tensioners 270 and the support unit are disposed under the front press 260. When the press plate 262 is rotated about the press-plate hinge 264, the support plate and the arm-tension bars 272 are also rotated with the press plate 262. When the support plate is rotated about the support-plate hinge, the press plate 262 and the arm-tension bars 272 are not rotated. The arm-tension bars 272 are rotated about the arm-tensioner hinges 274, but the press plate 262 or the support plate are not rotated.

The end of the support leg 266 is mounted in the mounting recess 162 in the support-leg mount 160. The support leg 266 includes the holding pins 269, which movably project from the end thereof. The holding pins 269 project outwards from the support leg 266 by virtue of the elastic force of springs disposed in the support leg. When external pressure is applied to the holding pins 269, the holding pins 266 may be moved into the support leg 266. When the support leg 266 is mounted on the support-leg mount 160, the holding pins 269 are inserted into the holding holes (not shown) in the support-leg mount 160, whereby the support leg 266 is stably held on the support-leg mount 160.

The ironing plate 200 includes the neck clip 299, which holds the collar portion of the top in the steam-spraying mode. The neck clip 299 is disposed at the front surface 227 of the ironing plate 200. The neck clip 299 is drawn out of the ironing plate 200 forwards in the longitudinal direction L or is retracted into the ironing plate 200.

The system iron 10 according to the embodiment may further include a base plate 300 for supporting the body 100 and the ironing plate 200. The base plate 300 has a size and a weight such that the ironing plate 200 is stably secured on the body 100 both in the ironing mode and in the steam-spraying mode.

The base plate 300 may further include casters (not shown), which enable the system iron 10 to be easily moved.

Figure 14:
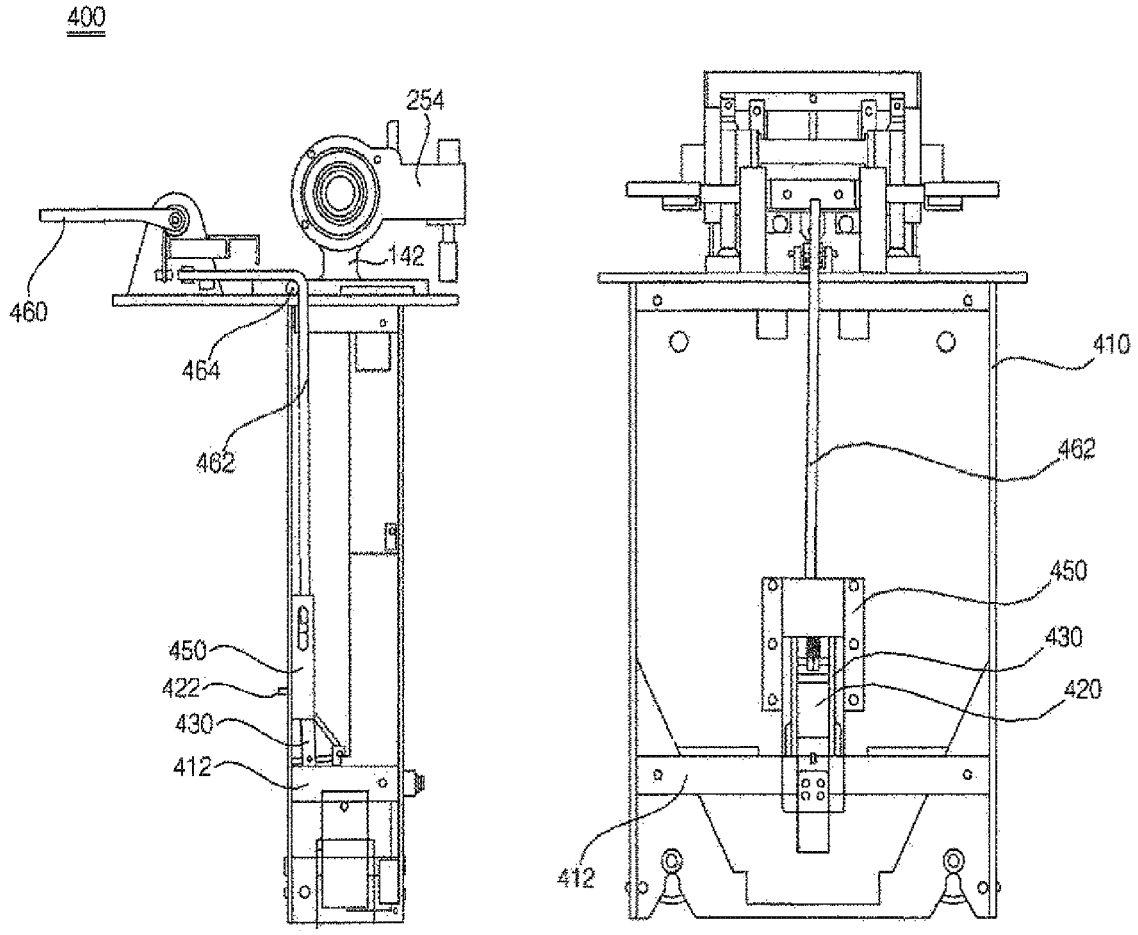
FIG. 14 is a view illustrating the interior of a height adjustment unit in order to explain the principle of operation of the height adjustment unit shown in FIG. 5.
Figure 15:
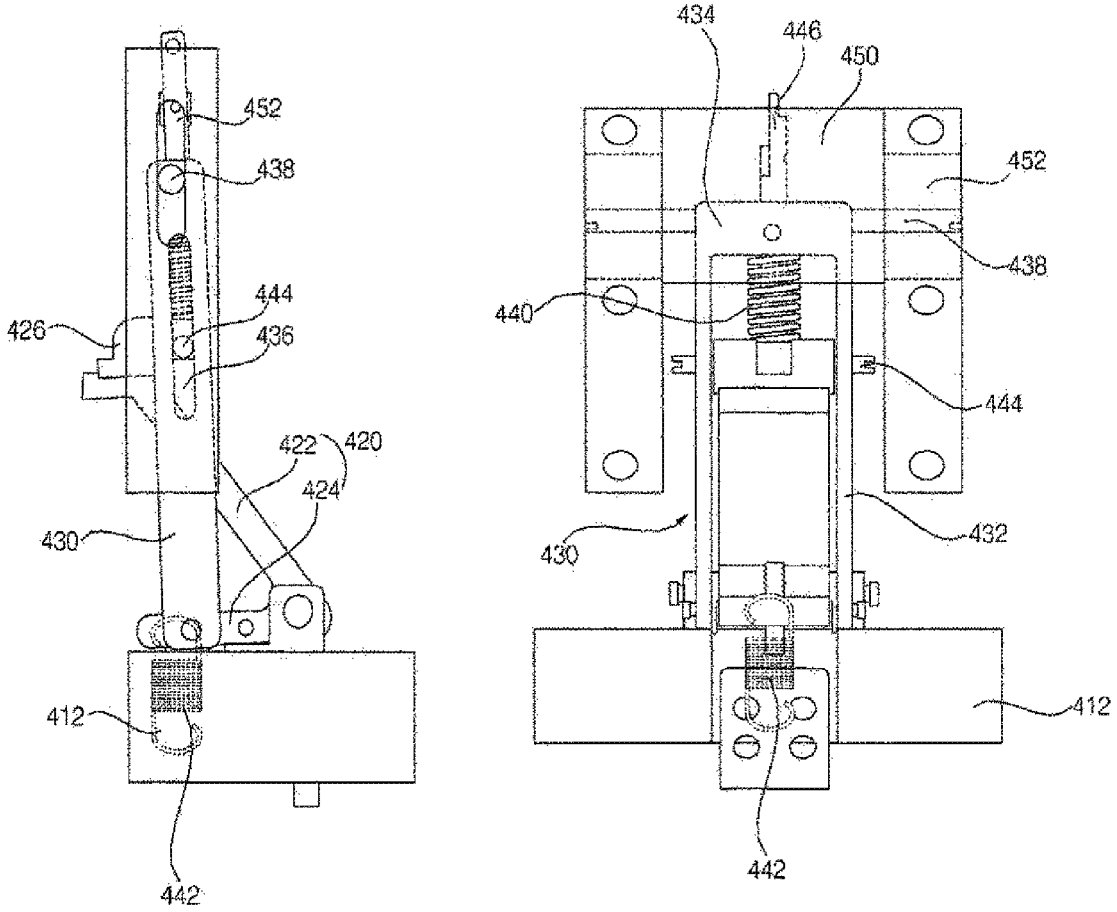
FIG. 15 is a view illustrating a locking unit of the height adjustment unit according to an embodiment of the present invention.
Figure 16:
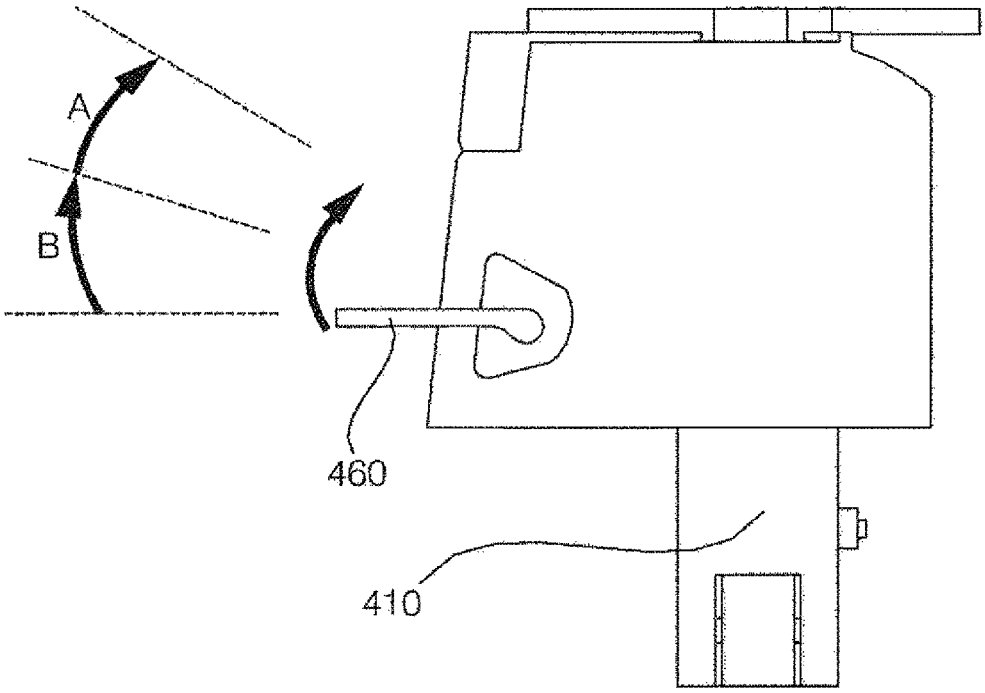
FIG. 16 is a view illustrating the relationships among a first elastic member, a second elastic member and a height adjustment lever of the locking unit according to an embodiment of the present invention.

FIG. 14 is a view illustrating the interior of the height adjustment unit in order to explain the principle of operation of the height adjustment unit shown in FIG. 5. FIG. 15 is a view illustrating the locking unit of the height adjustment unit according to an embodiment of the present invention. FIG. 16 is a view illustrating relationships among a first elastic member, the second elastic member and the height adjustment lever of the locking unit according to an embodiment of the present invention.

Hereinafter, the height adjustment unit according to the embodiment will be described with reference to FIGS. 5 and 14 to 16. The height adjustment unit according to the embodiment serves to adjust the height of the ironing plate coupled to the upper portion of the body.

The system iron 10 according to the embodiment includes the body 100 including therein the steam generator for generating steam; the ironing plate 200 disposed on the body so as to spray the steam, generated from the steam generator, to the outside; the height adjustment box 410, which is retracted into the body or is projected from the body so as to adjust the height of the ironing plate; a lock 420 including a first bar, which projects outwards from the height adjustment box so as to limit the movement of the height adjustment box; a lock holder 430 connected to opposite side surfaces of the lock and changing the position of the first bar so as to allow the height adjustment box to be moved; and the height adjustment lever 460 for moving the lock holder by means of a wire.

The height adjustment box 410, the lock 420, the lock holder 430 and the height adjustment lever 260 may be considered to be the constituents of the height adjustment unit 400 for adjusting the height of the ironing plate 200 of the system iron 10, and the lock 420 and the lock holder 430 may be considered to be constituents of the locking unit for limiting the movement of the height adjustment box 410.

The height adjustment box 410 is retracted into the body 100 or is extended outwards from the body 100 so as to adjust the height of the ironing plate 200 from the ground surface. The height adjustment box 410 is disposed under the upper body 110. The height adjustment box 410 may be disposed in the lower body 112 or may be extended upwards from the lower body 112. The height adjustment box 410 adjusts the height of the ironing plate 200 by raising or lowering the upper body 110 and the ironing plate 200.

The height adjustment box 410 is provided therein with the lock 420 for limiting the movement of the height adjustment box 410, the lock holder 430 connected to opposite side surfaces of the lower end of the lock 420, and an underframe 412 disposed under the lower side of the lock 420 so as to support the lower end of the lock 420. The lock 420 is hingedly coupled to the underframe 412. The height adjustment box 410 is provided in one side surface thereof with the projection hole 414 through which the first bar 422 of the lock 420 projects.

When the first bar 422 of the lock 420 projects outwards from the height adjustment box 410 through the projection hole 414 in the height adjustment box 410, the movement of the height adjustment box 410 is limited.

The lock 420 limits the movement of the height adjustment box 410. The first bar 422 of the lock 420 projects outwards from the height adjustment box 410 so as to limit the movement of the height adjustment box 410. The lock 420 is hingedly connected to the underframe 412 disposed in the height adjustment box 410.

The lock 420 includes the first bar 422, which is rotated about a hinge shaft and a portion of which projects outwards from the height adjustment box 410, and a second bar 424, which is connected to the lock holder 430 and which moves the position of the first bar 422 by the movement thereof. The lower portion of the second bar 424 may be in contact with the underframe 412 or may be spaced apart from the underframe 412. The second bar 424 is rotated together with the first bar 422 about the hinge shaft. The lock holder 430 is connected to the two side surfaces of the second bar 424. When the second bar 424 is rotated by means of the lock holder 430, the first bar 422 is also rotated within the same range.

The first bar 422 is disposed so as to be inclined with respect to the second bar 424. The first bar 422 is connected at one end thereof to the second bar 424. The first bar 422 and the second bar 424 are rotated together about the same hinge shaft. The other end of the first bar 422 may project outwards from the height adjustment box 410. The first bar 422 is bent in a direction parallel to the second bar 424 at the other end thereof, which projects outwards from the height adjustment box 410.

The lock holder 430 moves the position of the first bar 422 of the lock 420. The lock holder 430 moves the first bar 422 of the lock 420 into the height adjustment box 410. The lock holder 430 is connected to the two side surfaces of the second bar 424. The lock holder 430 is configured to have a 'U' shape. The lock holder 430 is connected to the height adjustment lever 460 by a wire 462. The lock holder 430 may be moved upwards by means of the height adjustment lever 460. The lock holder 430 transmits force generated by the height adjustment lever 460 to the lock 420. The lock holder 430 transmits the force generated by the height adjustment lever 460 to the second bar 424. The lock holder 430 moves the second bar 424 upwards, thereby changing the position of the first bar 422.

The lock holder 430 includes a top bar 434, which is connected to the height adjustment lever 460 via the wire 462, and a pair of side bars 432, which are vertically bent downwards from the two ends of the top bar 434 and which are connected to the two side surfaces of the second bar 424. The top bar 434 is disposed above the first bar 422.

The height adjustment unit 400 includes a first elastic member 440, which is disposed between the top bar 434 and the first bar 422 so as to exert elastic force, and a first sliding bar 444 for transmitting the elastic force of the first elastic member 440 to the upper portion of the first bar 422. The side bars 432 in the lock holder 430 are provided with first guide holes 436 for guiding the movement of the first sliding bar 444.

The first sliding bar 444 is moved along the first guide holes 436 in the side bars 432. The height adjustment unit 400 may include a wire-connecting bar 446, which extends through the first elastic member 440 so as to connect the first sliding bar 444 to the wire 462. However, the wire 462 may also extend through the first elastic member 440 so as to be directly connected to the first sliding bar 444.

When the height adjustment lever 460 is actuated, the first sliding bar 444 is moved upwards along the first guide holes 436 so as to move the lock holder 430 upwards. When the height adjustment lever 460 is not actuated, the first elastic member 440 applies elastic force to the upper portion of the first bar 422, thereby locking the lock 420.

The other end of the first bar 422, which projects outwards from the height adjustment box 410, is provided thereon with an obstruction portion 426. The obstruction portion 426 is disposed before the first sliding bar 444. Since the first sliding bar 444 is moved upwards and downwards along the first guide holes 436, the first sliding bar 444 limits the movement of the obstruction portion 426 of the first bar 422 in the backward direction of the first sliding bar 444. Since the obstruction portion 426 is disposed before the first sliding bar 444, the first bar 422 is prevented from being raised.

The height adjustment unit 400 according to the present invention includes a second sliding bar 438, which projects from the side bars 432 so as to guide the vertical movement of the lock holder 430, and a stationary body 450, which is disposed outside the lock holder 430 and which has therein second guide holes 452 for guiding the movement of the second sliding bar 438. The stationary body 450 is fixedly secured to an internal side surface of the height adjustment unit 400.

The lock holder 430 is moved vertically along the second guide holes 452 in the stationary body 450 by means of the second sliding bar 438. Since the lock holder 430 is moved vertically along the second guide holes 452 in the stationary body 450 by means of the second sliding bar 438, upward and rearward movement of the first bar 422 independently of actuation of the height adjustment lever 460 is prevented.

The height adjustment unit according to the embodiment dually prevents upward and rearward movement of the first bar 422 independently of actuation of the height adjustment lever 460 by means of the first sliding bar 444, the first guide holes 436 in the lock holder 430 and the second guide holes 452 in the stationary body.

The height adjustment unit 400 according to the embodiment further includes a second elastic member 442 for exerting downward elastic force on the second bar 424.

The second elastic member 442 provides elastic force in order to maintain the state in which the projecting portion of the lock 420 projects outwards from the height adjustment box 410. The second elastic member 442 is disposed under the second bar 424 and is connected thereto. The elastic force of the second elastic member 442 is set to be greater than that of the first elastic member 440. Accordingly, as long as a user does not apply force of a predetermined level or higher, only the sliding bar 444 is moved upwards, but the entire lock holder 430 is not moved upwards.

The operation of the first elastic member 440 and the second elastic member 442 when a user actuates the height adjustment lever 460 will now be described with reference to FIG. 16. Even when the height adjustment lever 460 is rotated to the angle B by a user, only the first sliding bar 444 is moved along the first guide holes 436 in the lock holder 430, and the lock 420 is thus prevented from rotating. When a user rotates the height adjustment lever 460 within the range of angle B, force equal to or greater than the elastic force of the first elastic member 440 has to be applied. When the height adjustment lever 460 is actuated within the range of angle B, the lock 420 is not rotated, thereby ensuring a safety margin corresponding to angle B.

When a user rotates the height adjustment lever 460 beyond the range of angle B, the lock holder 430 is raised by the first sliding bar 444 and the lock 420 is thus rotated, thereby allowing the height adjustment box 410 to be moved. When a user rotates the height adjustment lever 460 beyond the range of angle B, force equal to or greater than the sum of the elastic force of the first elastic member 440 and the elastic force of the second elastic member 442 has to be applied. When a user rotates the height adjustment lever 460 to the angle A+B, the first bar 422 of the lock 420 is positioned in the height adjustment box 410, thereby allowing the height adjustment box 410 to be moved.

The height adjustment lever 460 is disposed above the height adjustment box 410. The height adjustment lever 460 according to the embodiment is disposed at a portion of the upper body 110. The height adjustment lever 460 is connected to the lock holder 430 via the wire 462. The wire 462 connects the height adjustment lever 460 to the lock holder 430. The height adjustment unit 400 includes at least one roller 464 for changing the direction in which the wire 462 extends. The wire 462 connects the lock holder 430 to the height adjustment lever 460, which is positioned above and in front of the lock holder 430, by way of the roller 464. A user may rotate the height adjustment lever 460 upwards. When the height adjustment lever 460 is rotated upwards, the lock holder 430 is moved upwards owing to the tensile force of the wire 462.

Hereinafter, the operation of the height adjustment unit of the system iron according to the embodiment will be described.

In the height adjustment unit 400 according to the embodiment, when a user actuates the height adjustment lever 460, the locked state of the lock 420 is released, thereby allowing the height adjustment box 420 to be moved. Since the height adjustment box 410 is disposed under the ironing plate 200, it is possible to adjust the height of the ironing plate 200 by moving the height adjustment box 410 upwards or downwards.

As long as a user does not actuate the height adjustment lever 460, the height adjustment box 410 is maintained in the locked state because the first bar 422 of the lock 420 projects outwards from the height adjustment box 410. When the height adjustment box 410 is in the locked state, the first elastic member 440 applies elastic force to the upper portion of the first bar 422, thereby maintaining the height adjustment box 410 in the locked state. When the height adjustment box 410 is in the locked state, the second elastic member 442 pulls the second bar 424 downwards, thereby maintaining the height adjustment box 410 in the locked state.

In addition, since the obstruction portion 426 is provided on the first bar 422 and the first sliding bar 444 is disposed behind the obstruction portion 426, the movement of the first bar 422 is limited, thereby maintaining the height adjustment box 410 in the locked state.

Accordingly, even when the tensile force of the wire 462 is reduced because pressure is applied to the ironing plate 200 from above, the position of the first bar 422 of the lock 420 is not changed, thereby maintaining the height adjustment box 410 in the locked state.

When a user rotates the height adjustment lever 460 upwards, the lock holder 430 is moved upwards by means of the wire 462 connected to the height adjustment lever 460. However, although the height adjustment lever 460 is actuated, only the first elastic member 460 and the first sliding bar 444, which are connected to the wire 462, are moved upwards along the first guide holes 436 as long as the height adjustment lever is actuated within a predetermined range, whereby the lock holder 430 is not moved upwards. Accordingly, even when the height adjustment lever is actuated to some extent due to a user's carelessness, it is possible to ensure the safety margin corresponding to the range of the movement of the first sliding bar.

When a user actuates the height adjustment lever 460 beyond the range of movement of the first sliding bar 444, the lock holder 430 is moved upwards. The lock holder 430 is moved upwards and downwards along the second guide holes 452 in the stationary body 450 by means of the second sliding bar 438 disposed on the side surfaces of the lock holder 430. As the lock holder 430 is moved upwards, the second bar 424 connected to the lock holder 430 is rotated upwards about the hinge shaft. As the second bar is rotated about the hinge shaft, the first bar, connected to the second bar, is also rotated about the hinge shaft. Consequently, the other end of the first bar 422, which projects outwards from the height adjustment box 410, is retracted into the height adjustment box 410, and thus the locked state of the height adjustment box 410 is released. When the locked state of the height adjustment box 410 is released, the height adjustment box 410 is allowed to be moved upwards and downwards, with the result that it is possible to adjust the height of the ironing plate 200.

The invention claimed is:

1. A system iron comprising:

a body including therein a steam generator for generating steam;

an ironing plate disposed on the body so as to spray the steam generated by the steam generator to an outside;

a height adjustment box, which is retracted into the body and extended outwards from the body so as to adjust a height of the ironing plate;

a lock including a first bar, which projects outwards from the height adjustment box so as to limit movement of the height adjustment box;

a lock holder, which is connected to two side surfaces of an end of the lock so as to change a position of the first bar, thereby allowing the height adjustment box to be moved; and a height adjustment lever for moving the lock holder via a wire, wherein the lock includes:

the first bar, which is rotated about a hinge shaft and a portion of which projects outwards from the height adjustment box; and a second bar, which is connected at two side surfaces thereof to the lock holder and which changes a position of the first bar by movement of the lock holder.

2. The system iron according to claim 1, wherein the lock is hingedly connected to an underframe disposed in the height adjustment box.

3. The system iron according to claim 1, further comprising a first elastic member, which is disposed between the lock holder and the first bar so as to apply elastic force to the first bar.

4. The system iron according to claim 1, wherein the lock holder includes:

a top bar connected to the height adjustment lever via the wire; and a pair of side bars, which are bent downwards at two ends of the top bar and are respectively connected to the two side surfaces of the second bar of the lock.

5. The system iron according to claim 4, further comprising:

a first elastic member disposed between the top bar and the first bar so as to apply elastic force to the first bar; and a first sliding bar for transmitting the elastic force of the first elastic member to an upper portion of the first bar, wherein the pair of side bars include first guide holes for guiding movement of the sliding bar.

6. The system iron according to claim 5, wherein the first bar is provided thereon with an obstruction portion, which is disposed before the first sliding bar.

7. The system iron according to claim 4, further comprising:

a second sliding bar, which projects from the pair of side bars so as to guide upward and downward movement of the lock holder; and a stationary body having second guide holes for guiding movement of the second sliding bar outside the lock holder.

8. The system iron according to claim 1, further comprising a second elastic member for applying downward elastic force to the second bar.

9. The system iron according to claim 5, further comprising a second elastic member for applying downward elastic force to the second bar, wherein the elastic force of the second elastic member is greater than the elastic force of the first elastic member.

10. The system iron according to claim 1, wherein the body includes:

an upper body, which is connected at an upper portion thereof to the ironing plate and is connected at a lower portion thereof to the height adjustment box; and a lower body defining therein a space for accommodating the height adjustment box.

11. The system iron according to claim 10, wherein the height adjustment lever is disposed before the upper body, and wherein the system iron further comprises a roller for changing a direction in which the wire extends.

* * * * *